US008104413B1

(12) United States Patent
Rodriguez

(10) Patent No.: US 8,104,413 B1
(45) Date of Patent: Jan. 31, 2012

(54) CAMLESS AUTOMATED THREAD CUTTING SYSTEM FOR ELECTRONIC LOCKSTITCH PATTERN TACKING SEWING MACHINES

(75) Inventor: Felipe Rodriguez, Highland, IN (US)

(73) Assignee: ISM Services LLC, Highland, IN (US)

( * ) Notice: Subject to any disclaimer, the term of this patent is extended or adjusted under 35 U.S.C. 154(b) by 394 days.

(21) Appl. No.: 12/431,454

(22) Filed: Apr. 28, 2009

Related U.S. Application Data

(60) Provisional application No. 61/048,333, filed on Apr. 28, 2008.

(51) Int. Cl.
*D05B 65/00* (2006.01)

(52) U.S. Cl. ..... 112/296

(58) Field of Classification Search ..... 112/291, 112/294, 295, 296–298, 300, 301; 83/13, 83/39, 202, 910
See application file for complete search history.

(56) References Cited

U.S. PATENT DOCUMENTS

| | | | | | |
|---|---|---|---|---|---|
| 1,395,274 | A | * | 11/1921 | Hagelstein | 112/292 |
| 3,173,392 | A | * | 3/1965 | Hedgegaard | 112/292 |
| 3,543,737 | A | | 12/1970 | Maschmann | |
| 3,624,735 | A | * | 11/1971 | Hedegaard | 112/292 |
| 3,738,297 | A | | 6/1973 | Sangiorgi | |
| 4,235,179 | A | | 11/1980 | Ross | |
| 4,289,087 | A | | 9/1981 | Takenoya et al. | |
| 4,417,531 | A | | 11/1983 | Doyama | |
| 4,459,925 | A | | 7/1984 | Miyachi et al. | |
| 4,471,707 | A | * | 9/1984 | Astrupgaard et al. | 112/292 |
| 4,598,657 | A | | 7/1986 | Makabe et al. | |
| 4,599,961 | A | | 7/1986 | Brusasca et al. | |
| 4,672,902 | A | | 6/1987 | Michaels | |
| 4,987,842 | A | | 1/1991 | Nakamura et al. | |
| 5,062,374 | A | | 11/1991 | Wokeck et al. | |
| 5,065,683 | A | | 11/1991 | Hayashi | |
| 5,178,084 | A | | 1/1993 | Rohr | |
| 5,372,079 | A | | 12/1994 | Kitai et al. | |
| 5,603,272 | A | | 2/1997 | Takahashi et al. | |
| 5,881,658 | A | | 3/1999 | Nozaki et al. | |
| 5,964,170 | A | * | 10/1999 | Gries | 112/291 |
| 5,967,069 | A | | 10/1999 | Rodriguez et al. | |
| 6,289,831 | B1 | | 9/2001 | Hanai et al. | |
| 6,672,232 | B2 | * | 1/2004 | Enns et al. | 112/291 |

OTHER PUBLICATIONS

Brother KE-484C Product Literature, c. 2003, 4 pages. Brother LK3-B430 Series Product Literature, c. 1992, 6 pages.
Brother LK3-B430E Series Product Literature, c. 1997, 8 pages.
Brother LK3-B480 Series Product Literature, c. 1991, 4 pages.
Brother LK3-B430NP Parts Book, undated, 2 pages.
IN2000 Data Sheet, c.2006, 2 pages.

* cited by examiner

*Primary Examiner* — Tejash Patel
(74) *Attorney, Agent, or Firm* — William F. Bahret

(57) ABSTRACT

A camless automated thread cutting system for an electronic lockstitch pattern tacking sewing machine having a sewing needle driven by a main shaft and having a knife mechanism in proximity with the needle for cutting thread at the end of a pattern sewing cycle. The cutting system comprises a pneumatic cylinder for mechanically engaging the knife mechanism through a mechanical linkage in the machine, a solenoid-actuated air valve in fluid communication with the pneumatic cylinder, a programmable logic controller (PLC), and a pair of independently adjustable discs mounted on the main shaft of the sewing machine and operatively coupled to a proximity sensor which supplies an electrical signal to the PLC. The PLC is responsive to a machine signal indicative of the end of a sewing cycle and to the proximity sensor signal for generating a control signal for actuation of the valve so as to initiate and subsequently terminate a knife movement sequence at the end of the sewing cycle. The discs are preferably parallel, overlapping discs and the proximity sensor signal is preferably based on detection of the leading edge of one disc and the trailing edge of the other disc during rotation thereof.

8 Claims, 9 Drawing Sheets

CAMLESS AUTOMATED THREAD CUTTING SYSTEM FOR ELECTRONIC LOCKSTITCH PATTERN TACKING SEWING MACHINES

CROSS-REFERENCE TO RELATED APPLICATION

This application claims the benefit of Provisional Patent Application No. 61/048,333, filed Apr. 28, 2008, which application is hereby incorporated by reference along with all references cited therein.

BACKGROUND OF THE INVENTION

This invention relates to sewing machines and more particularly to thread cutting systems for lockstitch sewing machines. The invention is especially suited for electronically controlled lockstitch pattern tacking sewing machines.

Pattern tacking sewing machines are well known in which a thread cutting system employs a cutting cam and a cam follower mechanically connected to a cutting knife mechanism to cut the thread at the end of a sewing cycle, i.e., after a given pattern has been completed by the machine. Such machines have several disadvantages, including difficulty of adjustment for different jobs, which have not been fully overcome.

SUMMARY OF THE INVENTION

The present invention is a camless cutting system. The system controls a cutting knife mechanism with a pneumatic actuator, e.g., a pneumatic cylinder. The system controls the thread cutting or trimming sequence with a pair of adjustable bands or discs mounted on the main shaft or spindle of the sewing machine so as to rotate therewith and operatively coupled to a proximity sensor which supplies an electrical signal to an electronic controller such as a programmable logic controller (PLC). The electronic controller responds to a machine signal indicative of the end of a sewing cycle and to a signal from the proximity sensor to provide a control signal to an electrically actuated valve such as a solenoid-actuated air valve which supplies air pressure to the pneumatic actuator which drives the knife mechanism.

The objects and advantages of the present invention will be more apparent upon reading the following detailed description in conjunction with the accompanying drawings.

DESCRIPTION OF PREFERRED EMBODIMENTS

Figure 1:
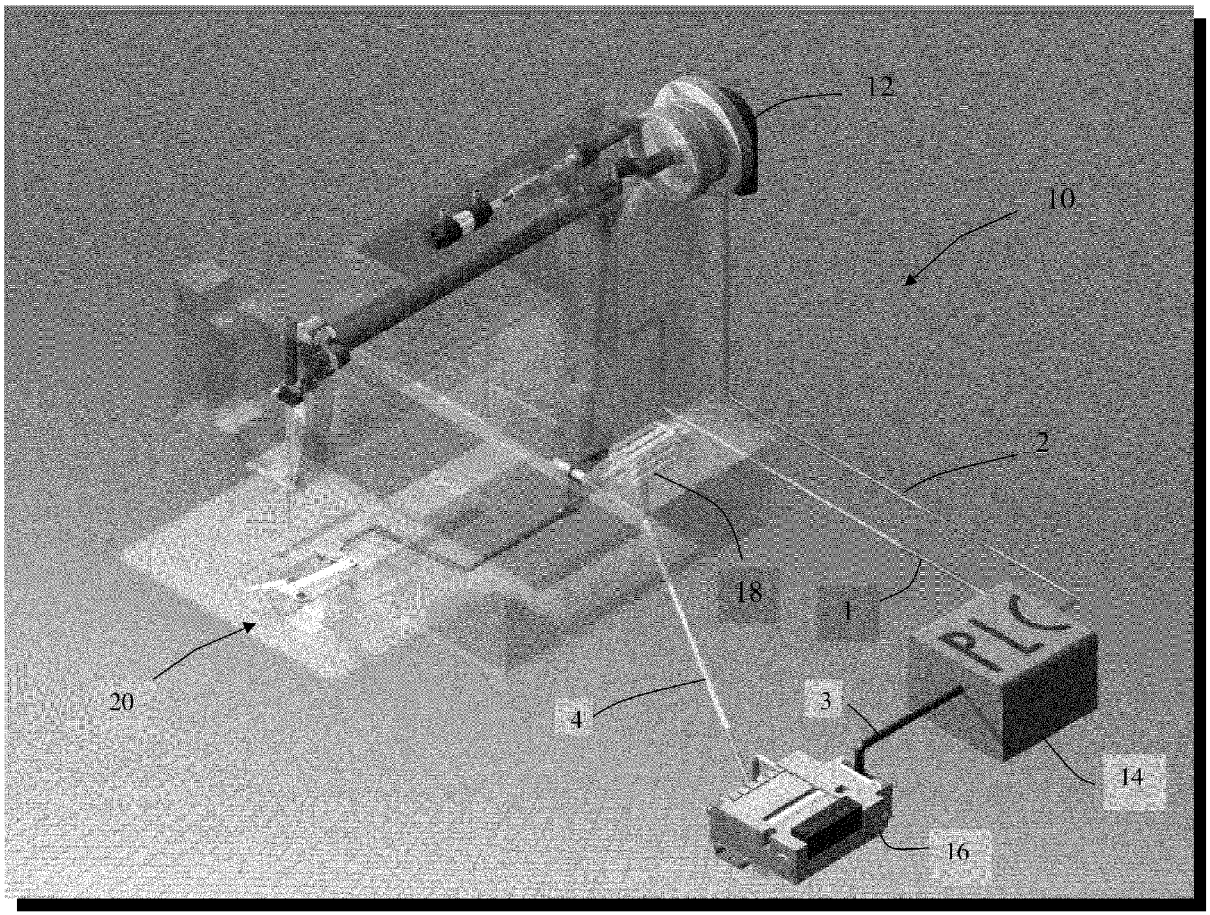
FIG. 1 is a diagram of a first embodiment of a camless cutting system according to the present invention, illustrated in operative association with an electronic lockstitch pattern tacking sewing machine having a sewing needle and an associated knife mechanism for cutting thread at the end of a pattern sewing cycle, the needle driven by the main shaft or spindle of the machine.

For the purpose of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device and such further applications of the principles of the invention as illustrated therein being contemplated as would normally occur to one skilled in the art to which the invention relates.

Figure 2:
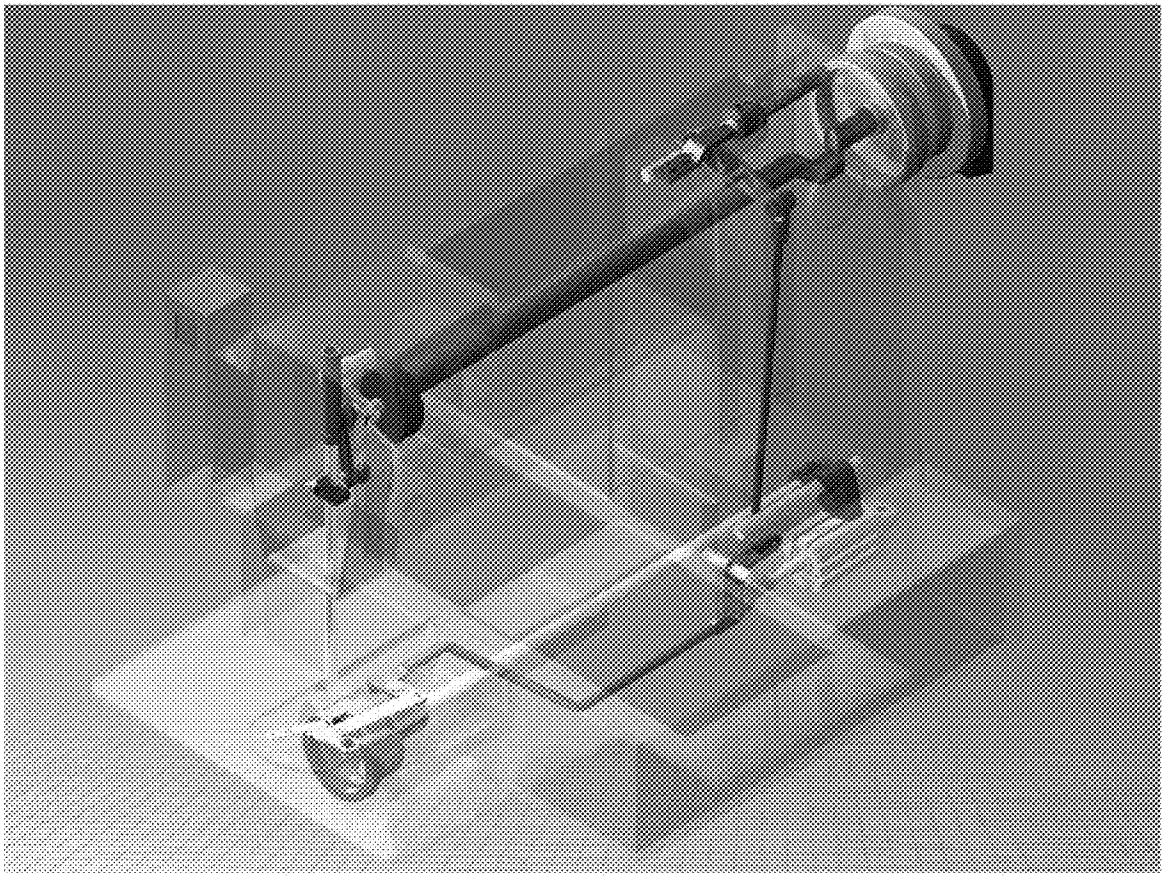
FIG. 2 is a somewhat more detailed diagram of the machine of FIG. 1 and shows the actuating cylinder of the camless cutting system of FIG. 1 engaging the knife mechanism of the machine through a mechanical linkage.
Figure 3:
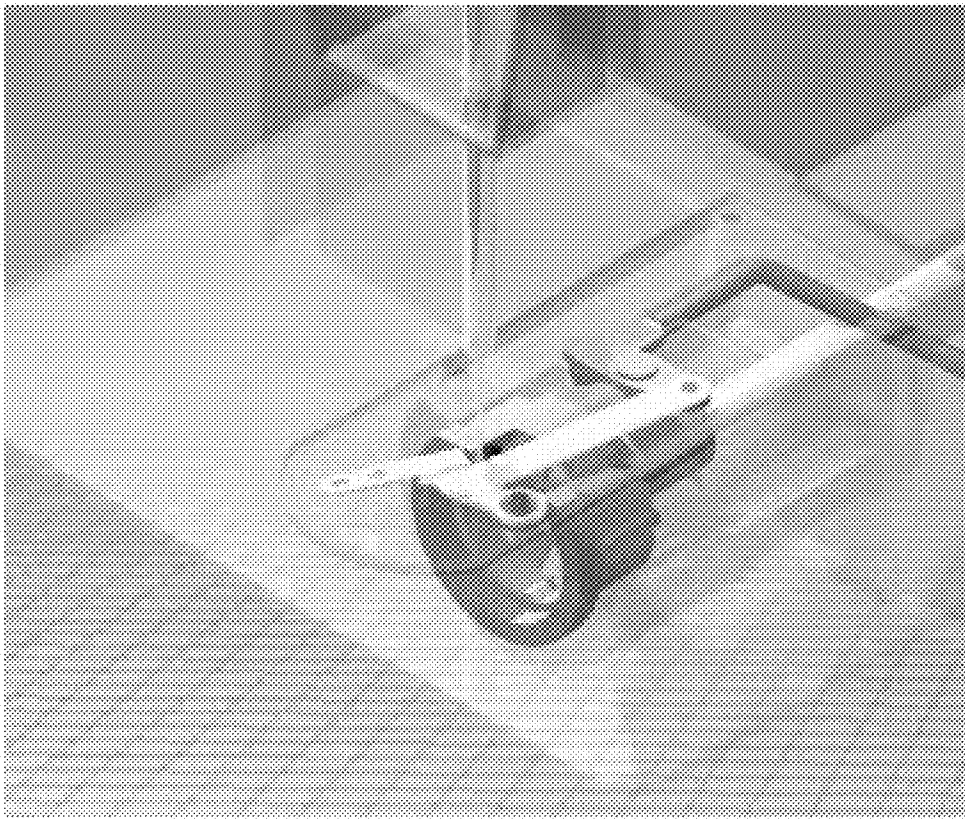
FIG. 3 is a drawing of the knife mechanism of FIG. 1 in further detail.
Figure 4:
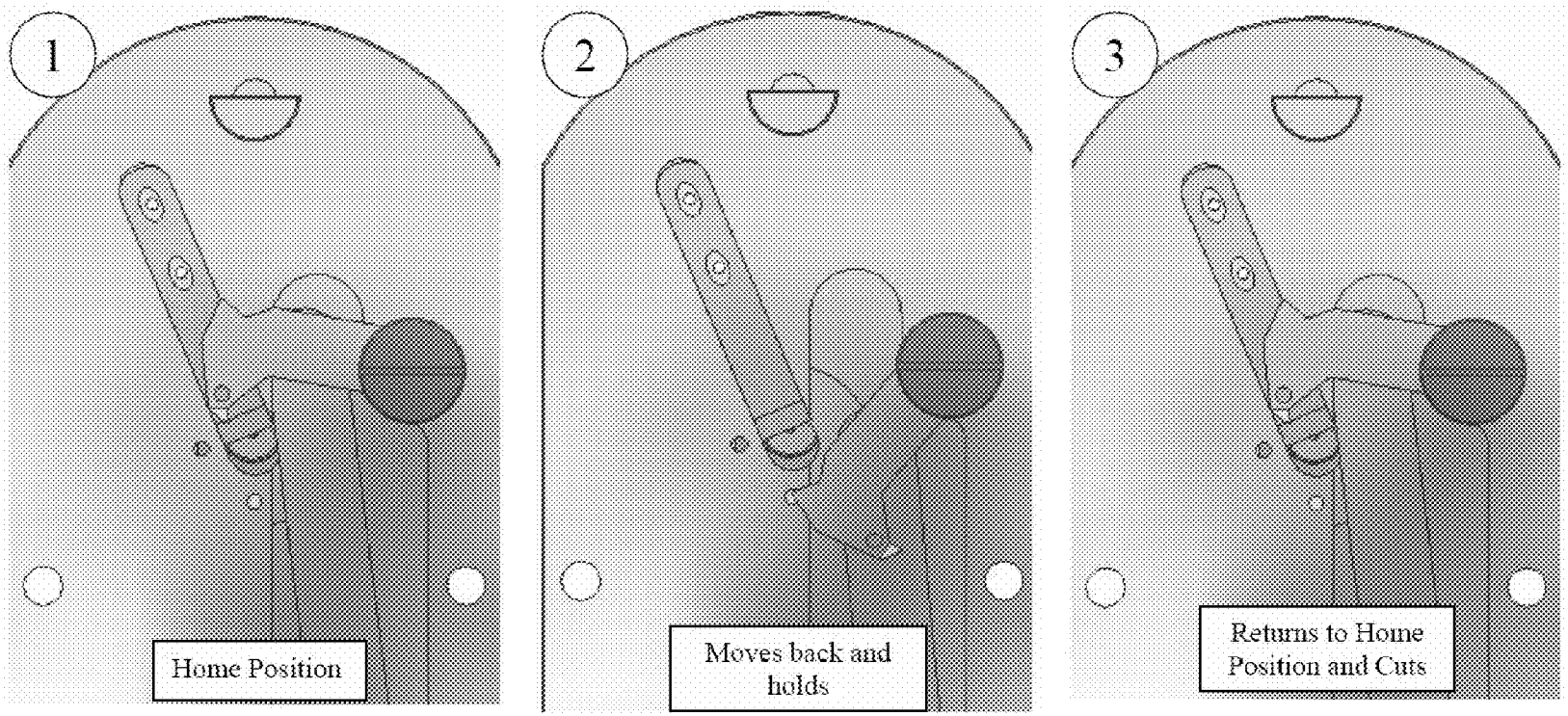
FIG. 4 shows bottom views of the knife mechanism in three positions: home, retracted, and returned home after a thread cut.

FIG. 1 illustrates a first embodiment 10 of the present invention and shows an example cutting system including a sensor 12, a PLC 14, a valve manifold 16, a cylinder 18, and a mechanical linkage to a cutting knife mechanism 20. FIG. 2 shows the machine in somewhat more detail, FIG. 3 shows the knife mechanism in further detail, and FIG. 4 shows bottom views of the knife mechanism in three positions: home, retracted, and returned home after a thread cut. From the home position, shown on the left, the knife moves back, catches the thread from the bobbin case and the thread from the oscillating shuttle hook, and holds the threads. After a predetermined hold time, the knife returns to the home position and cuts the threads in the process.

According to the present invention, the timing of these knife movements is under the control of an electronic controller such as the PLC, which receives one signal from the machine indicating the end of a sewing cycle, e.g., a last stitch signal from a controller in an electronic pattern tacker such as, for example, a Brother model 311 or 342. The PLC is programmed to respond to that signal (identified by reference numeral 1 in FIG. 1), and to a signal from sensor 12 (signal 2 in FIG. 1). The latter signal is generated by sensor 12 as the proximity sensor detects the passage of the leading edge 1 and trailing edge 2 of disc pair (see FIGS. 5-7). The leading edge causes the PLC to initiate the knife movement sequence, i.e., by activating the cylinder to cause the knife to move from its home position as discussed above. The trailing edge causes the PLC to deactivate the cylinder and thereby cause the knife to cut the threads while returning to its home position. The PLC controls the cylinder via the air valve, supplying a cut signal to a solenoid in the valve manifold on line 3 in FIG. 1. The valve supplies air through line 4 to the cylinder.

Figure 5B:
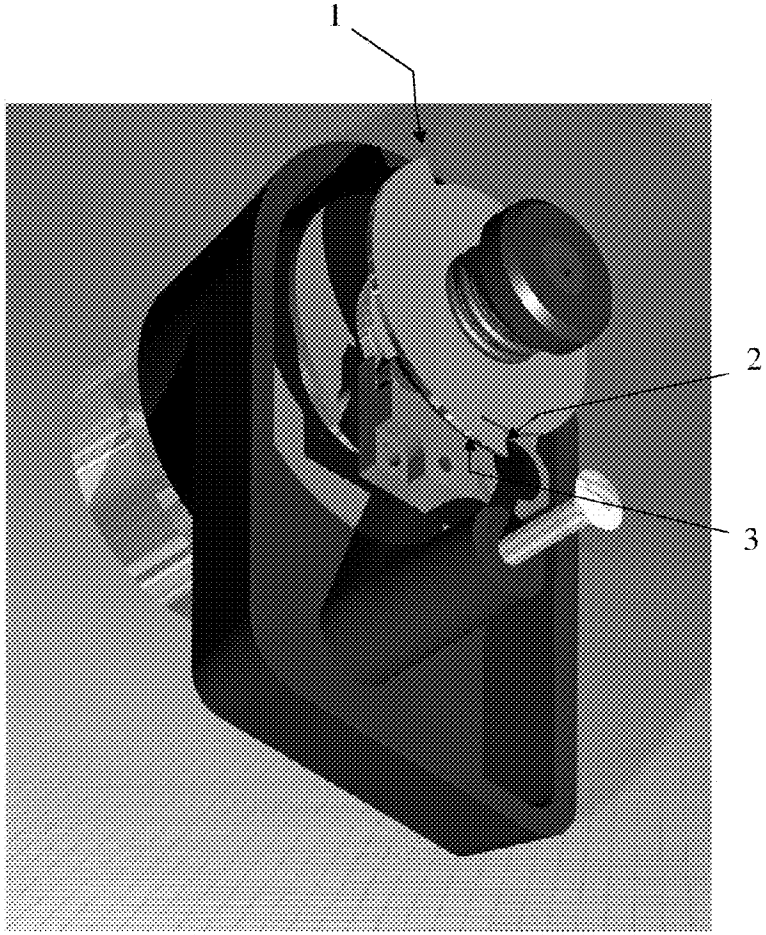
FIGS. 5A and 5B are drawings of one embodiment of a sensor according to the present invention, the sensor including two parallel, overlapping discs and a proximity sensor operatively coupled thereto for detection of the leading edge of one disc and the trailing edge of the other disc during rotation thereof.
Figure 5A:
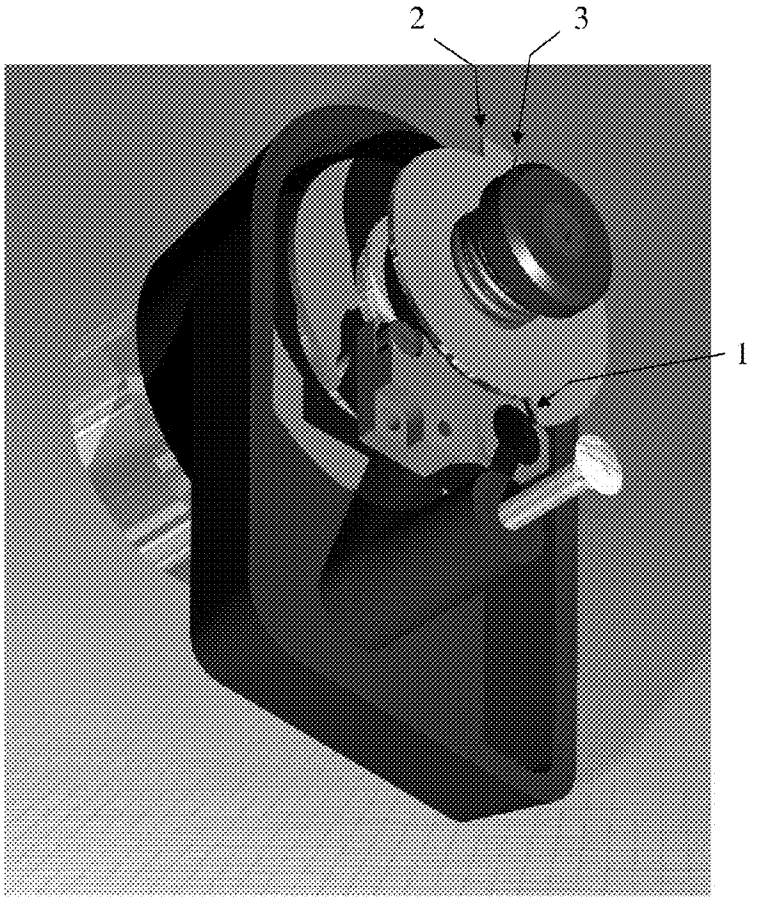
Figure 6B:
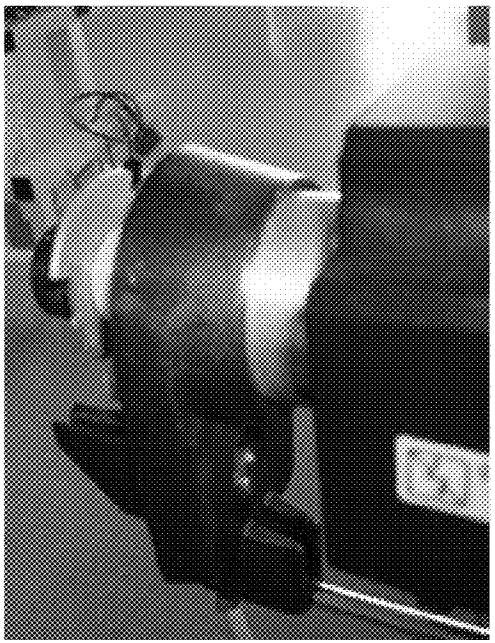
FIGS. 6A, 6B, 7A and 7B are photographs of the sensor embodiment of FIGS. 5A and 5B on the rear end of the main shaft of the machine.
Figure 6A:
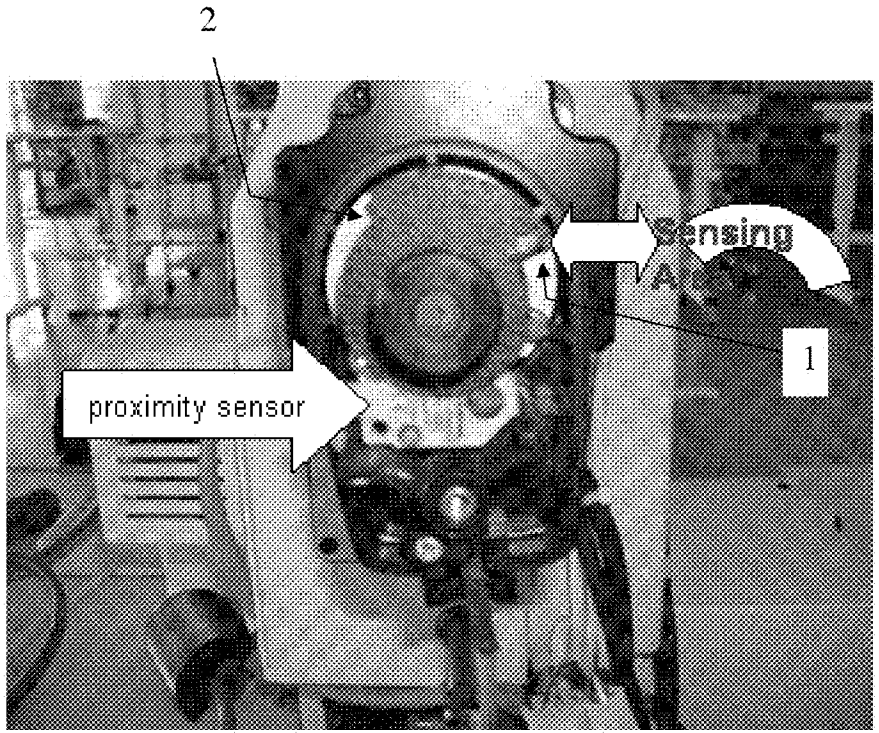
Figure 7B:
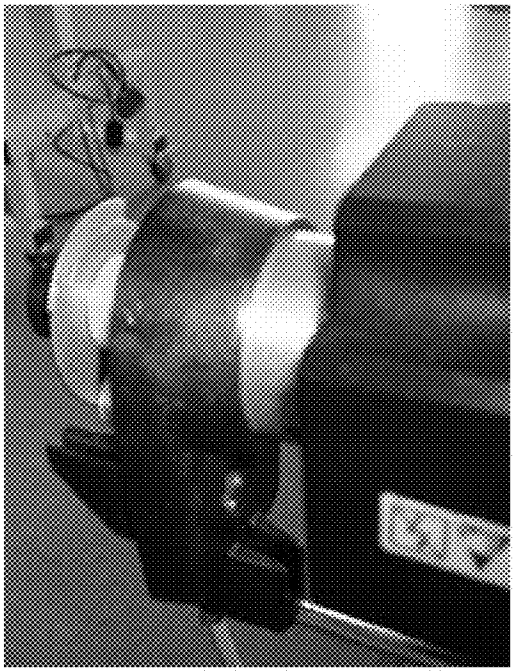
Figure 7A:
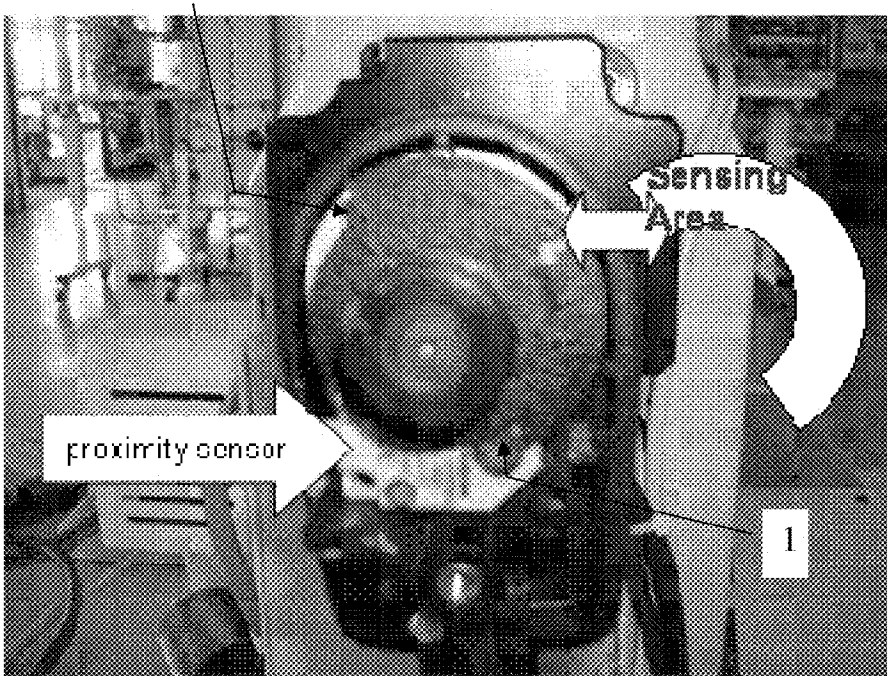

FIGS. 5A and 5B show drawings of an embodiment of a sensor 12 according to the present invention, and FIGS. 6A, 6B, 7A and 7B are photographs thereof. As can be appreciated from the drawings and photographs, there are two parallel bands or discs in contact with each other. Each disc has two edges: Edge 1 and another edge 3 are formed on one disc, and edge 2 is formed on the other disc along with another edge which is perhaps best seen in FIG. 7B. The discs rotate in sync with the up and down movement of the needle while the hook is oscillating during the sewing cycle. The span between edges 1 and 2 determines the hold time for the knife and is manually adjustable by moving one or both of the discs. That is, the discs are independently adjustable in angular orientation, and are advantageously adjustable by hand such that the machine can be quickly adjusted without any special tools or control devices, e.g., by a line manager on an assembly line where such machines are being used. Thus, the beginning and end of a thread cutting sequence can be independently and readily set by manual rotation of the discs with the spindle held stationary.

Thread tension is preferably controlled separately from dual-band sensor 12. A separate pneumatic cylinder is provided for this purpose as shown in FIG. 1. The PLC supplies an activation signal to the tension cylinder when tension is desired on the thread for the thread cutting process. The tension cylinder drives a tension rod to release or apply tension so that the thread is properly tightened for the cutting process at the end of the sewing cycle.

Figure 8:
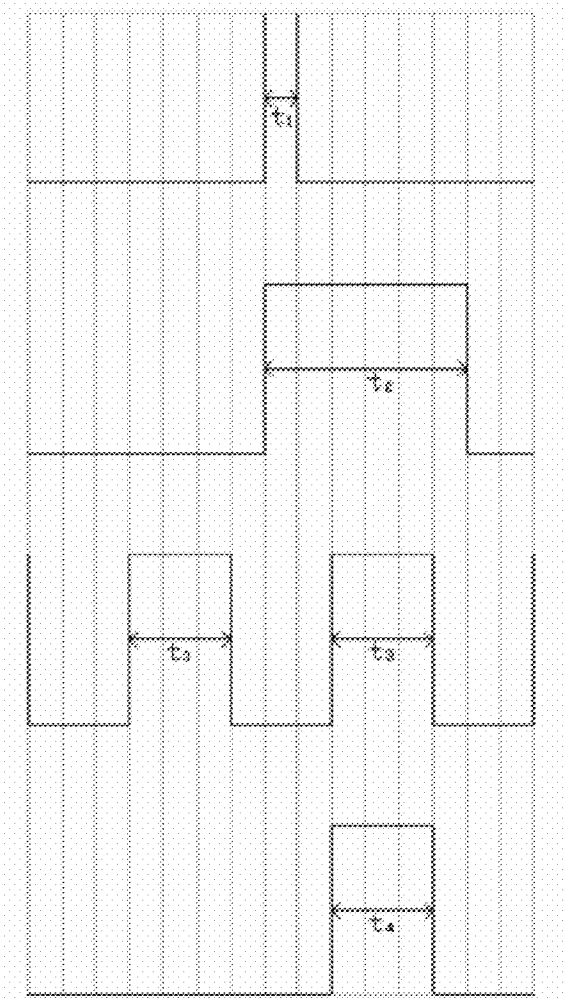
FIG. 8 is a timing diagram showing an example of the relative timing of pulses used by the camless cutting system of FIG. 1.

FIG. 8 is a timing diagram showing an example of the relative timing of pulses from the machine. The uppermost pulse in the diagram is an end-of-cycle pulse from the machine and may have a duration $t_1$. In a case such as shown where $t_1$ is relatively short, the PLC generates a longer pulse or timing window of width $t_2$ in response to the first pulse. Sensor 12 generates a waveform with pulses having width $t_3$ as shown, and the PLC generates a pulse of width $t_4$ as the cut signal for the solenoid valve. Note that $t_4=t_3$ in this embodiment. That is, the timing discs control the start and duration of the knife movement sequence. It will be appreciated by those skilled in the art that the machine cuts thread only when $t_2$ and $t_3$ coincide, which occurs once per sewing cycle. As indicated above, the start and duration ($t_3$) are adjustable.

Figure 9:
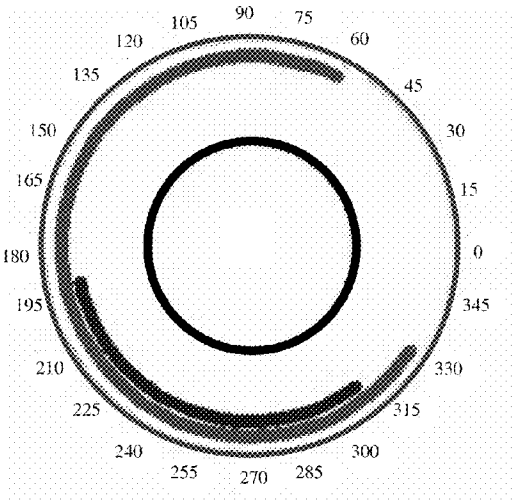
FIG. 9 is a drawing of an example configuration of adjustable bands or discs for use with the camless cutting system according to the present invention.
Figure 10:
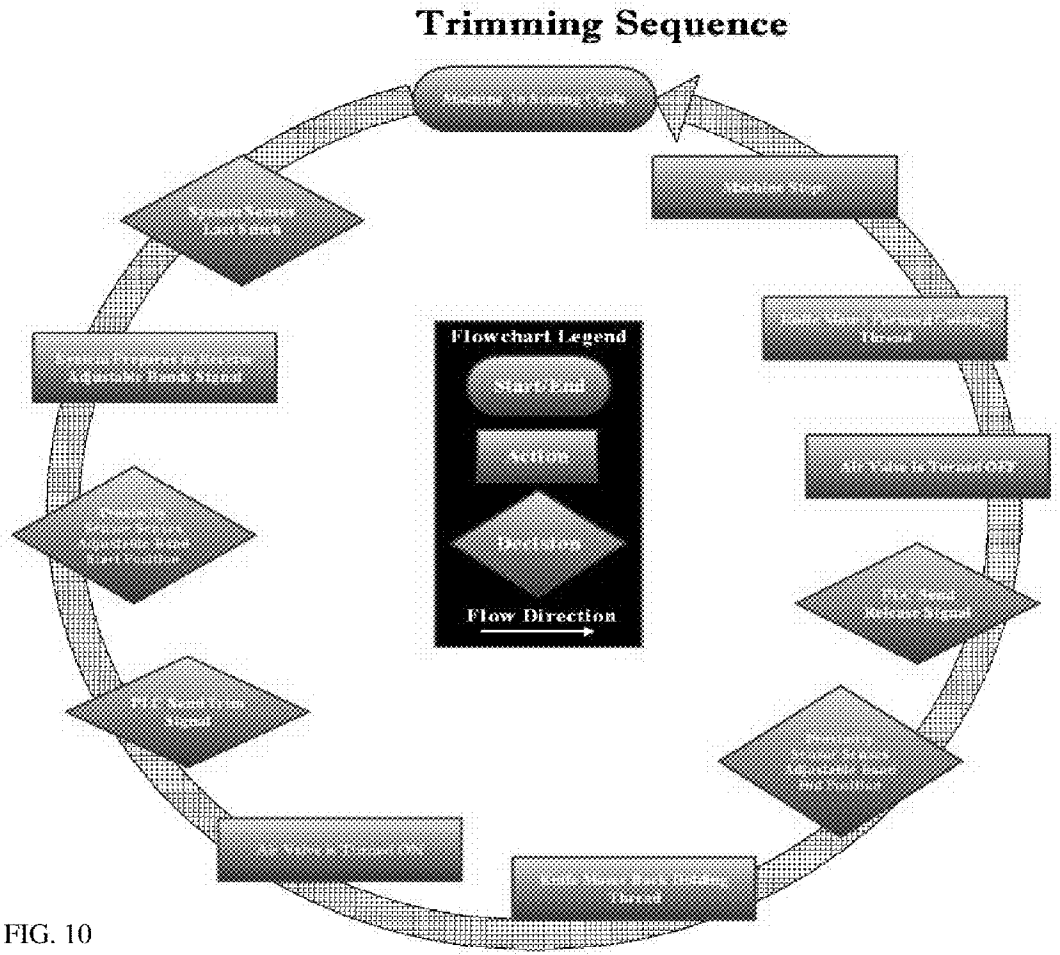
FIG. 10 is a flowchart of the program controlling the operation of the cutting system of FIG. 1.

Another example configuration of the adjustable bands (discs) is shown in FIG. 9, and FIG. 10 is a flowchart of the program controlling operation of the cutting system.

Figure 11:
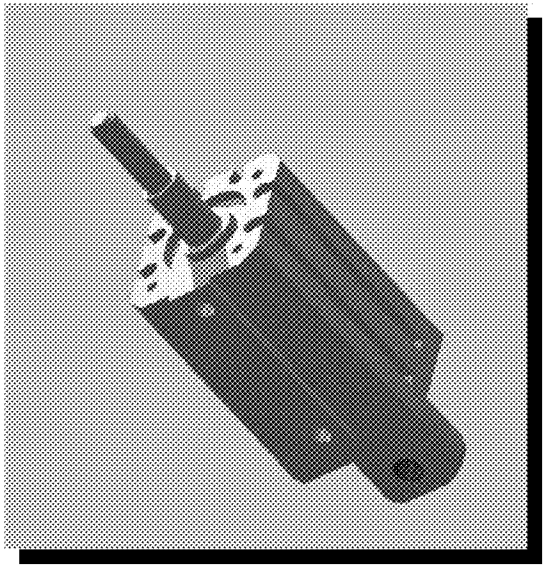
FIG. 11 is a drawing of an embodiment of a cutting cylinder for use in the present invention.

FIG. 11 shows an embodiment of a cutting cylinder for use in the present invention. Such a sensor is made by SMC. Among other applications, a cutting system according to the present invention may be advantageously implemented as a retrofit of an existing electronic pattern tacking sewing machine which employs a cutting cam, for example, a Brother machine such as identified above. The dual-band sensor described above is preferably mounted on the rear end of the machine spindle as shown, for example, in FIGS. 1, 6 and 7.

Further subject matter relevant to features of the invention as described above may be found in the following patents, which are incorporated herein by reference along with all references cited therein: U.S. Pat. No. 5,967,069 to Rodriguez, and U.S. Pat. No. 6,289,831 to Hanai.

While the invention has been illustrated and described in detail in the drawings and foregoing description, the same is to be considered as illustrative and not restrictive in character, it being understood that only preferred embodiments have been shown and described and that all changes and modifications that come within the spirit of the invention are desired to be protected.

What is claimed is:

1. A camless automated thread cutting system for an electronic lockstitch pattern tacking sewing machine having a sewing needle driven by a main shaft and having a knife mechanism in proximity with said needle for cutting thread at the end of a pattern sewing cycle, said system comprising:

a pneumatic actuator for mechanically engaging and actuating the knife mechanism;

an electrically actuated valve in fluid communication with said pneumatic actuator;

an electronic controller having first and second inputs, said first input for receiving a signal from the machine indicative of the end of a sewing cycle, and a control signal output to said valve for actuation thereof;

a plurality of discs adapted for mounting on the main shaft for rotation therewith whereby said discs rotate in sync with upward and downward needle movement during the sewing cycle, said discs being independently adjustable in angular orientation; and a proximity sensor operatively coupled to said plurality of discs for detection of first and second points thereof during rotation thereof, said sensor supplying a corresponding signal to said second input of said electronic controller;

wherein said electronic controller is responsive to the machine signal and to said proximity sensor signal for generating said control signal for actuation of said valve so as to initiate and subsequently terminate a knife movement sequence at the end of the sewing cycle.

2. The cutting system of claim 1, wherein said discs are parallel to each other and partially overlap angularly;

wherein said first and second points of said plurality of discs correspond to a leading edge of one disc and a trailing edge of another disc in the direction of rotation; and wherein said leading and trailing edges respectively determine the beginning and end of a knife movement sequence.

3. The cutting system of claim 2, wherein the angular orientation of each disc is readily adjusted by manual rotation of the disc, whereby the start of a knife movement sequence and the hold time of the knife mechanism are both readily adjustable.

4. The cutting system of claim 3, wherein said cutting system is adapted for retrofit to an electronic pattern tacking sewing machine having a cutting cam, with said plurality of discs and said proximity sensor mounted on the rear end of the main shaft of the machine.

5. The cutting system of claim 3, wherein said valve is a solenoid valve and said pneumatic actuator is a pneumatic cylinder engaging the knife mechanism through a mechanical linkage in the machine.

6. The cutting system of claim 3, wherein said electronic controller is a programmable logic controller.

7. The cutting system of claim 1, wherein said proximity sensor signal is a sequence of pulses of width corresponding to the predetermined hold time of the knife mechanism; and wherein said control signal for said valve is generated in response to the first pulse in said sequence of pulses occurring after the onset of the machine signal.

8. The cutting system of claim 1, wherein the machine signal is a short pulse and said electronic controller responds thereto by generating a longer pulse;

wherein said proximity sensor signal is a sequence of pulses of width corresponding to the predetermined hold time of the knife mechanism; and wherein said control signal for said valve is determined by the logical AND function of said longer pulse and said sequence of pulses from said proximity sensor.

* * * * *